US011131222B2

(12) United States Patent
Schwoerer et al.

(10) Patent No.: US 11,131,222 B2
(45) Date of Patent: Sep. 28, 2021

(54) ENGINE VALVE ACTUATION WITH HANDOFF CONTROL BETWEEN COOPERATIVE VALVE ACTUATION MOTIONS

(71) Applicant: Jacobs Vehicle Systems, Inc., Bloomfield, CT (US)

(72) Inventors: John A. Schwoerer, Storrs Mansfield, CT (US); Justin D. Baltrucki, Canton, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 0 days.

(21) Appl. No.: 17/249,090

(22) Filed: Feb. 19, 2021

(65) Prior Publication Data

US 2021/0262369 A1 Aug. 26, 2021

Related U.S. Application Data

(60) Provisional application No. 62/979,717, filed on Feb. 21, 2020.

(51) Int. Cl.
*F01L 1/34* (2006.01)
*F01L 13/00* (2006.01)
(Continued)

(52) U.S. Cl.
CPC ..... *F01L 13/0036* (2013.01); *F01L 1/04* (2013.01); *F01L 13/06* (2013.01)

(58) Field of Classification Search
CPC ..... F01L 13/0036; F01L 13/06
See application file for complete search history.

(56) References Cited

U.S. PATENT DOCUMENTS 7,392,772 B2 7/2008 Janak et al.
2005/0274341 A1 12/2005 Usko et al.
(Continued)

FOREIGN PATENT DOCUMENTS

EP 0242228 B1 7/1993
JP H07133708 A 5/1995
JP 2005233031 A 9/2005

OTHER PUBLICATIONS

Schwoerer, J., et al., "Lost-Motion VVA Systems for Enabling Next Generation Diesel Engine Efficiency and After-Treatment Optimization," SAE Technical Paper 2010-01-1189, Apr. 12, 2010, 14 pages.

(Continued)

*Primary Examiner* — Zelalem Eshete
(74) *Attorney, Agent, or Firm* — Moreno IP Law LLC

(57) ABSTRACT

A valve actuation system comprises a first motion transfer mechanism operatively connected to a first valve actuation motion source and to the at least one engine valve, a second motion transfer mechanism operatively connected to a second valve actuation motion source; and a selectable coupling mechanism between the first and second motion transfer mechanisms. The coupling mechanism is operable in a first state where first valve actuation motions are conveyed to the at least one engine valve via the first motion transfer mechanism, and a second state where second valve actuation motions are additionally conveyed to the at least one engine valve via the second motion transfer mechanism, the coupling mechanism and the first motion transfer mechanism. During a handoff between the first and second valve actuation motions or vice versa, a difference in valve actuation velocities of the first and second valve actuation motions does not exceed a threshold.

16 Claims, 10 Drawing Sheets

(51) Int. Cl.
*F01L 13/06* (2006.01)
*F01L 1/04* (2006.01)

(56) References Cited

U.S. PATENT DOCUMENTS

| | | | | |
|---|---|---|---|---|
| 2006/0005796 | A1 | 1/2006 | Janak et al. | |
| 2008/0308055 | A1 | 12/2008 | Swanbon | |
| 2013/0306013 | A1* | 11/2013 | Zurface | F01L 13/0021 123/90.16 |

OTHER PUBLICATIONS

Chandras, P., et al., "Effect of Intake Valve Profile Modulation on Passenger Car Fuel Consumption," SAE Technical Paper 2018-01-0379, Apr. 3, 2018, 8 pages.
Brown, J., McCarthy Jr, J., and Brownell, S., "Frictional Differences between Rolling and Sliding Interfaces for Passenger Car Switching Roller Finger Followers," SAE Technical Paper 2018-01-0382, Apr. 3, 2018, 10 pages.
International Search Report for International App. No. PCT/IB2021/051446 dated May 18, 2021, 3 pages.
Written Opinion of the International Search Authority for International App. No. PCT/IB2021/051446 dated May 18, 2021, 3 pages.

* cited by examiner

ENGINE VALVE ACTUATION WITH HANDOFF CONTROL BETWEEN COOPERATIVE VALVE ACTUATION MOTIONS

FIELD

The instant disclosure relates generally to valve actuation systems in internal combustion engines and, in particular, to a valve actuation system having cooperative main and auxiliary valve actuation motions with handoff control therebetween.

BACKGROUND

Valve actuation systems are known in the art in which a main motion transfer mechanism and main valve actuation motion source, as well as an auxiliary rocker arm and an auxiliary actuation motion source, are provided. Main valve actuation motions are transmitted to the engine valve(s) when a selectable coupling mechanism is disabled. A combination of main and auxiliary valve actuation motions is transmitted to the engine valve(s) when the coupling mechanism is enabled. Main valve actuation motions may comprise conventional main event profiles. Auxiliary valve actuation motions may comprise auxiliary events for compression-release engine braking, brake gas recirculation, internal exhaust gas recirculation (IEGR) or may modify the main event profile to provide early opening or late closing, such as, but not limited to, late intake valve closing (LIVC) and early exhaust valve opening (EIVC).

A schematic illustration of a valve actuation system 101 of the type described above is illustrated with reference to FIG. 1. The valve actuation system 101 comprises a first motion transfer mechanism 104 operatively connected to a first valve actuation motion source 102 and configured to receive first valve actuation motions from the first valve actuation motion source 102. The first motion transfer mechanism 104 is also operatively connected to one or more engine valves 106 (associated with a cylinder 108 of an internal combustion engine 100) and configured to convey the first valve actuation motions to the at least one engine valve 106. As further shown, the valve actuation system 101 also comprises a second motion transfer mechanism 110 operatively connected to a second valve actuation motion source 112 and configured to receive second valve actuation motions from the second valve actuation motion source 112. A selectable coupling mechanism 114 is provided that permits selectable coupling of the first motion transfer mechanism 110 to the first motion transfer mechanism 104 under control of a control system 116 such that the second valve actuation motions may be applied to the at least one engine valve 106 via the second motion transfer mechanism 110, selectable coupling mechanism 114 and first motion transfer mechanism 104.

As known in the art, the engine valves 108 may comprise intake valves or exhaust valves and, in an embodiment, separate valve actuation systems 101 can be separately provided for different engine valve types associated with a single cylinder, e.g., one instance of a valve actuation system 101 for intake valves of the cylinder 108 and another instance of a valve actuation system 101 for exhaust valves of the cylinder 108. Although a single cylinder 108 is illustrated in FIG. 1 for ease of illustration, it is understood that the internal combustion engine 100 may, and typically will, comprise more than one such cylinder. Additionally, the implementation of the valve actuation motion sources 102, 112 and the motion transfer mechanisms 104, 110 may vary as known in the art. For example, the first and second motion transfer mechanisms 104, 110 may comprise Type III (center pivot) rocker arms equipped with cam rollers or tappets and operatively connected to corresponding cams. Alternatively, where the motion sources 102, 112 are provided by one or more overhead cams, the first and second motion transfer mechanisms 104, 110 may comprise Type II (end pivot) finger followers equipped with cam rollers contacting the corresponding overhead cams. Preferably, the selectable coupling mechanism 114 may comprise a hydraulically-activated, one-way coupling mechanism that permits valve actuation motions applied to the second motion transfer mechanism 110 to be selectively conveyed to the first motion transfer mechanism 104, but that does not permit valve actuation motions applied to the first motion transfer mechanism 104 to be conveyed to the second motion transfer mechanism 110. Further still, where the coupling mechanism 114 is hydraulically-controlled, the control system 114, which controls operating states of the coupling mechanism 114, may comprise a suitable engine control unit (ECU), as known in the art, in communication with one or more high-speed solenoids, also as known in the art. In this case, the ECU may control a solenoid valve to provide hydraulic fluid to, or to restrict flow of hydraulic fluid to, the coupling mechanism, thereby controlling its operating state.

An example of such a system is found in U.S. Pat. No. 7,392,772 and FIG. 2 illustrates the system described in the '772 patent. As shown in FIG. 2, a first/main rocker arm 200 is provided to provide main valve events, e.g., a main exhaust or intake valve event, received from a first/main valve actuation motion source (cam) 202. In this embodiment, the coupling mechanism 114 is integrated into first rocker arm 200, i.e., the first rocker arm 200 also comprises a laterally- extending boss 204 housing a coupling mechanism in the form of a hydraulically-activated actuator 206. The system further comprises a second/auxiliary rocker arm 210 aligned to receive valve actuation motions from a second/auxiliary valve actuation motion source (cam) 212. The second rocker arm 210 is also aligned with the boss 204 extending from the first rocker arm 200. A spring 214 is provided to bias the second rocker arm 210 into contact with the second valve actuation motion source 212 and away from the boss 204 such that lash or clearance space is provided between the boss 204 and a lash adjustment screw 216 disposed in a motion imparting end of the second rocker arm 200. During normal main event mode of operation of the engine, the actuator 206 is retracted into the boss 204, thereby preserving the lash between the first and second rocker arms 200, 210. In this manner, the second valve actuation motions are not conveyed from the second rocker arm 210 to the first rocker arm 200, i.e., they are "lost." On the other hand, when it is desired to add second valve actuation motions to the first valve actuation motions, the actuator 206 is hydraulically controlled to extend from the boss 204 and take up the lash space such that the second rocker arm 210 contacts the actuator 206 and thereby conveys the second valve actuation motions to the first rocker arm 200.

An example of such operation is further illustrated in FIG. 3 where a main exhaust event 300 is provided by the main valve actuation motion source 202 and one or more of the illustrated second/auxiliary valve events 310, 330, 340 are provided by the auxiliary valve actuation motion source 212. As described above, during positive power operation, only the main exhaust event 300 is conveyed via the first rocker arm 200 to, in the example of FIG. 2, a single engine valve 220. When the actuator 206 is extended, the one or more second valve events 310, 330, 340 are also conveyed via the first rocker arm 200 to the engine valve 220, i.e., in addition to the main exhaust event 300. A shortcoming of the prior art of FIG. 3 is that there is an impact between the actuator and the first rocker arm due to the large velocity mismatch between the main exhaust event 300 and auxiliary valve event 340 at that point where actuation of the engine valve is handed off from the main exhaust event 300 to the auxiliary valve event 340 (at approximately 380 degrees crank angle as shown in FIG. 3).

FIG. 4 illustrates another example of a system of the type illustrated in FIG. 1. In particular, the illustrated valve actuation system is substantially in accordance with the teachings of the '772 patent in that it comprises a first/main rocker arm 400 and a second/auxiliary rocker arm 402. As shown in FIG. 4, the first rocker arm 400 contacts a valve bridge 420 at its motion imparting end. Further, the first and second rocker arms 400, 402 each comprise respective roller followers (not shown) disposed in their motion receiving ends, which roller followers receive valve actuation motions from respective first and second valve actuation motion sources implemented, in this case, as cams on a camshaft (not shown). Similar to the above-described embodiment from the '772 patent, the first and second rocker arms 400, 402 have a hydraulically-activated actuator 406 that may be controlled into a retracted position in which no valve actuation motions are conveyed from the second rocker arm 402 to the first rocker arm 400, or in an extended position in which valve actuation motions are conveyed from the second rocker arm 402 to the first rocker arm 400. However, unlike the embodiment illustrated in FIG. 2, the actuator 406 is not housed in the first rocker arm 400, but in a boss 404 formed in a motion imparting end of the second rocker arm 402. In order to receive valve actuation motions from the actuator 406, the first rocker arm 400 comprises a lateral extension 412 that aligns with boss 404 and actuator 406.

It is possible that a dedicated second/auxiliary rocker/second/auxiliary motion source system of the types illustrated in FIGS. 2 and 4 could be used to implement VVA motions of the type described above. Generally, as used herein, such VVA motions are characterized in that they are essentially modifications of main valve actuation motions. Consequently, such VVA motions could be provided in a manner in which the first and second valve actuation motions cooperate with each other, i.e., the valve actuation motions provided by the separate motion sources overlap to provide a single desired valve event, as opposed to separate, substantially non-overlapping valve events provided by the separate motion sources. Stated another way, separate valve actuation motion sources cooperate with each other or provide a handoff, as used herein, to the extent that valve actuation motions provided by the second valve actuation motion source can take over control of actuation of an engine valve at such a time when a first valve actuation motion source is already providing lift to the engine valve, or vice versa. In this manner, a second valve actuation motion source may add valve actuation motions to a main valve event to alter timing, lift or duration of the main valve event without requiring a discrete separate event from the main event.

For example, FIG. 5 illustrates potential exhaust valve event in which a main valve actuation motion source provide a main exhaust event 500 and an auxiliary motion source provides an exhaust early valve opening (EEVO) event 502. In this case, where the EEVO event 502 is added to the main exhaust event 500, the valve would initially be opened (starting at approximately 0° of crank angle, as shown) by the EEVO event 502 until such time (at approximately 150° crank angle, as shown) where the higher lift provided by the main exhaust event 500 would take over control of the engine valve, which would thereafter follow the main lobe of the main exhaust event 500. A problem with the arrangement, however, is the sharp transition that would occur at the handoff point 504 where the main exhaust event 500 overtakes the EEVO event 502. In this case, the first/main rocker arm 200, 400 would experience a sudden change in velocity (essentially, a high impact) when transitioning from a relatively low-velocity portion of the EEVO event 502 immediately to a relatively high velocity portion of the main exhaust event 500. Such impacts are likely to accelerate wear, fatigue and potential failure of the valve train, particularly the first/main rocker arm 200, 400 in this case.

Additionally, while FIGS. 3 and 5 illustrate comparatively low-lift second/auxiliary valve actuation motions 310, 330, 340, 502, it may be desirable to incorporate relatively high-lift second/auxiliary valve actuation motion sources in some instances. However, physical constraints for a given engine may prohibit the inclusion of, for example, a comparatively larger second/auxiliary cam as the auxiliary actuation motion source.

Thus, systems implementing cooperative valve actuation motions without the above-noted drawbacks would represent an advancement of the art.

SUMMARY

The above-noted shortcomings of prior art solutions are addressed through the provision of a valve actuation system for actuating at least one engine valve, where the valve actuation system comprises a first motion transfer mechanism operatively connected to a first valve actuation motion source and to the at least one engine valve; a second motion transfer mechanism operatively connected to a second valve actuation motion source; and a selectable coupling mechanism disposed between the first motion transfer mechanism and the second motion transfer mechanism. The selectable coupling mechanism is operable in a first state where first valve actuation motions provided by the first valve actuation motion source are conveyed to the at least one engine valve via the first motion transfer mechanism and, when the selectable coupling mechanism is operated in a second state, in addition to the first valve actuation motions conveyed via the first motion transfer mechanism, second valve actuation motions provided by the second valve actuation motion source are conveyed to the at least one engine valve via the second motion transfer mechanism, the coupling mechanism and the first motion transfer mechanism. During a handoff between the first valve actuation motions and the second valve actuation motions or vice versa, a difference in valve actuation velocities of the first valve actuation motions and the second valve actuation motions does not exceed a threshold.

In an embodiment, the selectable coupling mechanism comprises a selectively extendable actuator, wherein the actuator is retracted during the first state and is extended during the second state. In this embodiment, the difference in valve actuation velocities does not exceed a threshold during transition of the actuator from the first state to the second state.

The first valve actuation motions may comprise a main event profile. The handoff may occur during an opening segment of the first valve actuation motions, for example where the second valve actuation motions comprise an early valve opening profile, or the handoff may occur during a closing segment of the first valve actuation motions, for example where the second valve actuation motions comprise late valve closing profile. The second valve actuation motions may further comprise a valve actuation motion that does not give rise to a handoff with the first valve actuation motions, e.g., an auxiliary event to provide internal exhaust gas recirculation (IEGR).

The at least one engine valve comprises an intake valve or an exhaust valve. Further, in an embodiment, the first and second valve actuation motion sources are cam profiles. The embodiments described herein may be incorporated into an internal combustion engine. Further still, a corresponding method is described.

BRIEF DESCRIPTION OF THE DRAWINGS

The features described in this disclosure are set forth with particularity in the appended claims. These features and attendant advantages will become apparent from consideration of the following detailed description, taken in conjunction with the accompanying drawings. One or more embodiments are now described, by way of example only, with reference to the accompanying drawings wherein like reference numerals represent like elements and in which:

DETAILED DESCRIPTION OF THE PRESENT EMBODIMENTS

Figure 1:
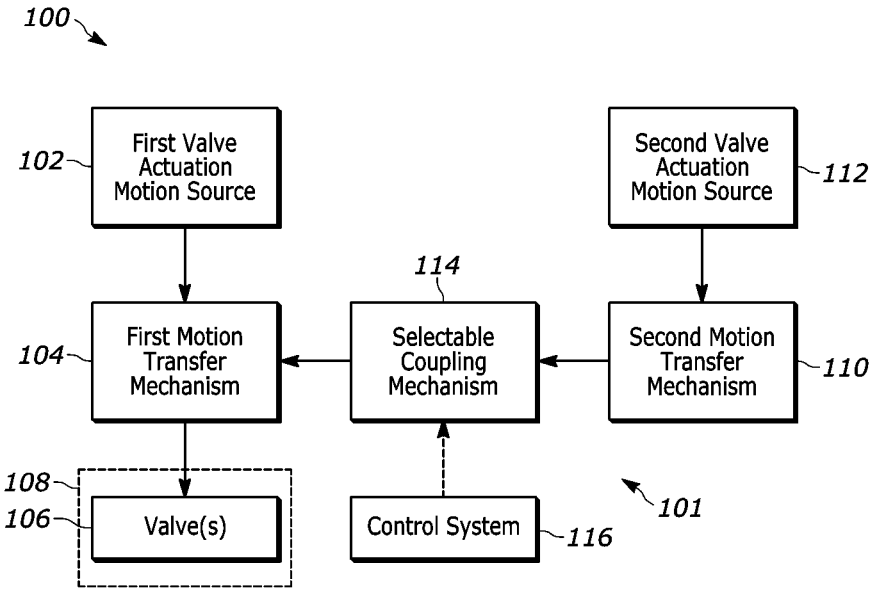
(Prior Art) FIG. 1
FIG. 1 is a generic illustration of a prior art valve actuation system that may be used to implement techniques in accordance with the instant disclosure.
Figure 2:
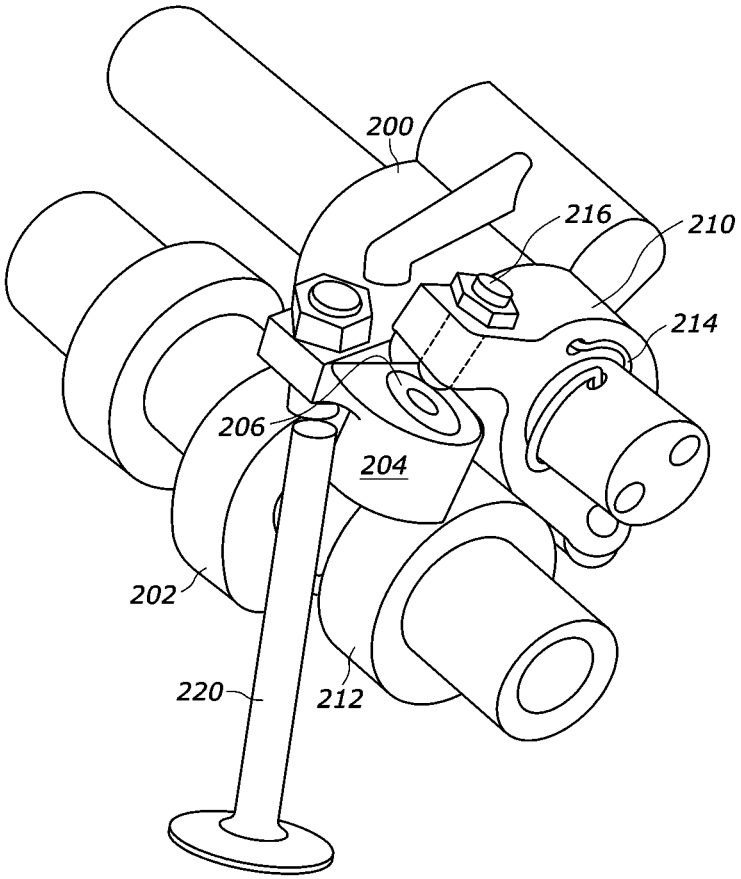
(Prior Art) FIG. 2
FIG. 2 illustrates an implementation of a valve actuation system in accordance with the system of FIG. 1 and that may be used to implement techniques in accordance with the instant disclosure.
Figure 3:
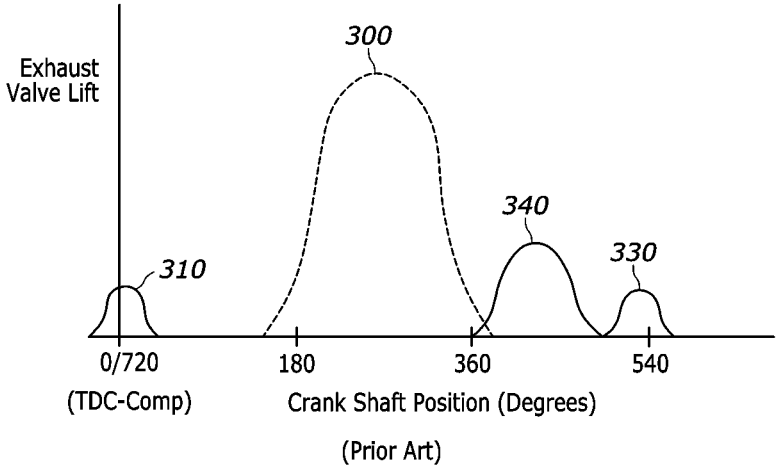
(Prior Art) FIG. 3
FIG. 3 illustrates an example of prior art main and auxiliary valve events.
Figure 4:
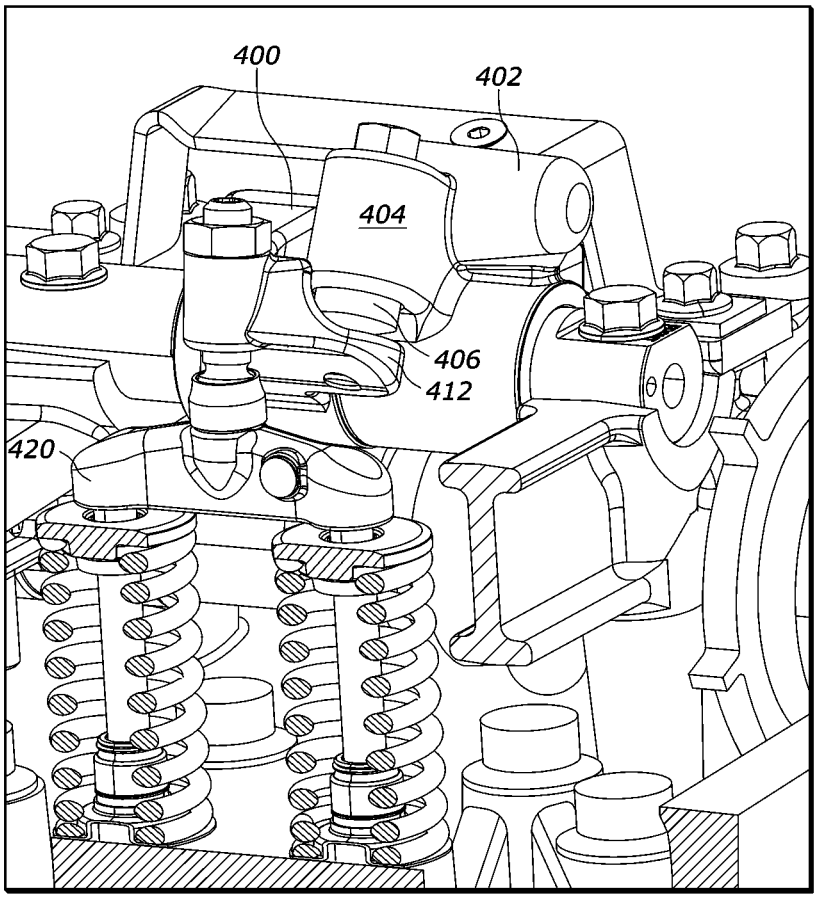
(Prior Art) FIG. 4
FIG. 4 illustrates another implementation of a valve actuation system in accordance with the system of FIG. 1 and that may be used to implement techniques in accordance with the instant disclosure.
Figure 5:
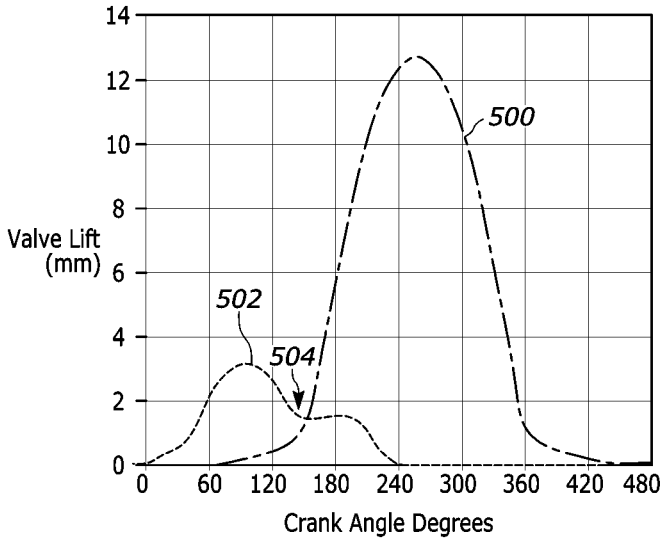
(Prior Art) FIG. 5
FIG. 5 illustrates a prior art example of a variable valve actuation event as implemented by a combination of first/main valve actuation motions and second/auxiliary valve actuation motions.
Figure 6:
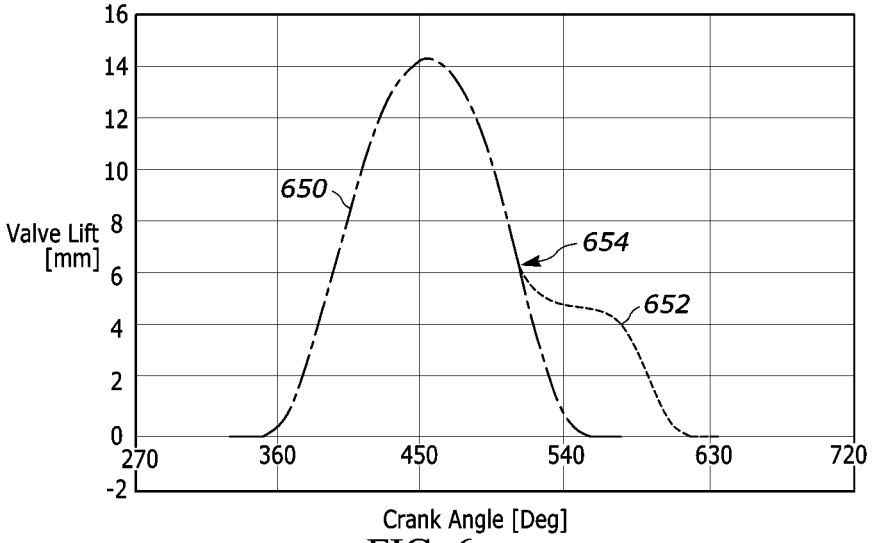
FIGS. 6 and 7 illustrates examples of first/main valve actuation motions and second/auxiliary valve actuation motions cooperating to provide late intake valve closing.
Figure 7:
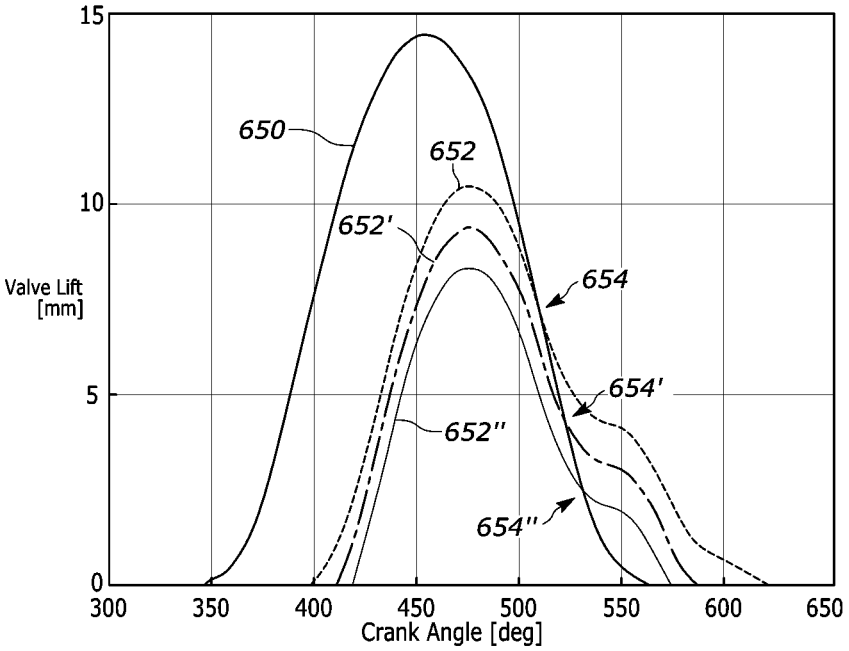

FIGS. 6 and 7 illustrates examples of first/main valve actuation motions and second/auxiliary valve actuation motions cooperating to provide late intake valve closing;

FIG. 6 illustrates a first example of first/main valve actuation motions and a portion of second/auxiliary valve actuation motions in accordance with the instant disclosure. In particular, FIG. 6 illustrates a main intake valve lift 650 and a late intake valve closing lift 652 provided by first/main and second/auxiliary actuation motion sources, respectively, cooperating to provide a late intake valve closing event. In this example, a portion of the late intake valve closing lift 652 overlapping with the larger lobe of the main intake valve lift 650 is not shown to extent that it is "hidden" by the main intake valve lift 650. As described above with reference to FIGS. 1, 2 and 4, when the second/auxiliary valve actuation motion 652 is lost (by virtue of, for example, retraction of the actuator 206, 406), only the main intake valve lift 650 would be conveyed to the engine valves, whereas when the auxiliary valve actuation motion 652 is conveyed to the main rocker arm (by virtue of extension of the actuator 206, 406), both the main intake valve lift 650 and the late intake valve closing lift 652 would be conveyed to the engine valves. In the latter case, only the main intake valve lift 650 would contribute to the actuation motions applied to the engine valves until a transition point or handoff 654 is reached, at which time only the higher lift provided by the late intake valve closing lift 652 would contribute to the actuation motions applied to the engine valves.

A particular feature of the lift curves 650, 652 in accordance with the instant disclosure is that the slopes of the respective curves at the handoff 654 (i.e., the first derivatives or tangents, being representative of the relative velocities occurring at that point) are selected such that that a difference between the slopes/velocities is less than a threshold maximum value. For example, as shown in FIG. 6, the respective slopes of the lift curves 650, 652 are very nearly identical at the handoff 654, implying that the velocities of components within the first/main valve train and second/auxiliary valve train (e.g., the respective first/main and second/auxiliary rocker arms) are very nearly identical at the handoff 654. As a result, when the of main valve train and auxiliary valve train components make contact at that point in time corresponding to the handoff 654, any impact between such components will be minimized.

As known in the art, however, valve trains comprising hydraulically activated components (e.g., an actuator) are subject to variability in the time it takes for such hydraulically activated components to be fully extended (or retracted). Further, compliance within such valve trains may result in less than optimal distances between respective valve train components, which in turn may affect when a handoff between cooperative first/main and second/auxiliary valve lifts will actually occur. Examples of this are illustrated in FIG. 7. In particular, FIG. 7 illustrates a situation in which the late intake valve closing lift 652 of FIG. 6 is not fully realized (due to, for example, late hydraulic filling of the actuator or valve train compliance), resulting in a delayed late intake valve closing lift 652'. As shown, the resulting handoff 654' occurs later relative to the scenario illustrated in FIG. 6, such that the difference in values of the velocities/slopes of the lift curves 650, 652' at the handoff 654' is larger. If this difference is large enough, i.e., larger than a maximum threshold, then undesirably large impacts could occur. An even more extreme, but nevertheless possible, scenario is also illustrated in FIG. 7, in which further delay in the late intake valve closing lift 652" results in a handoff 654" where the difference in velocities/slopes is even greater.

Figure 8:
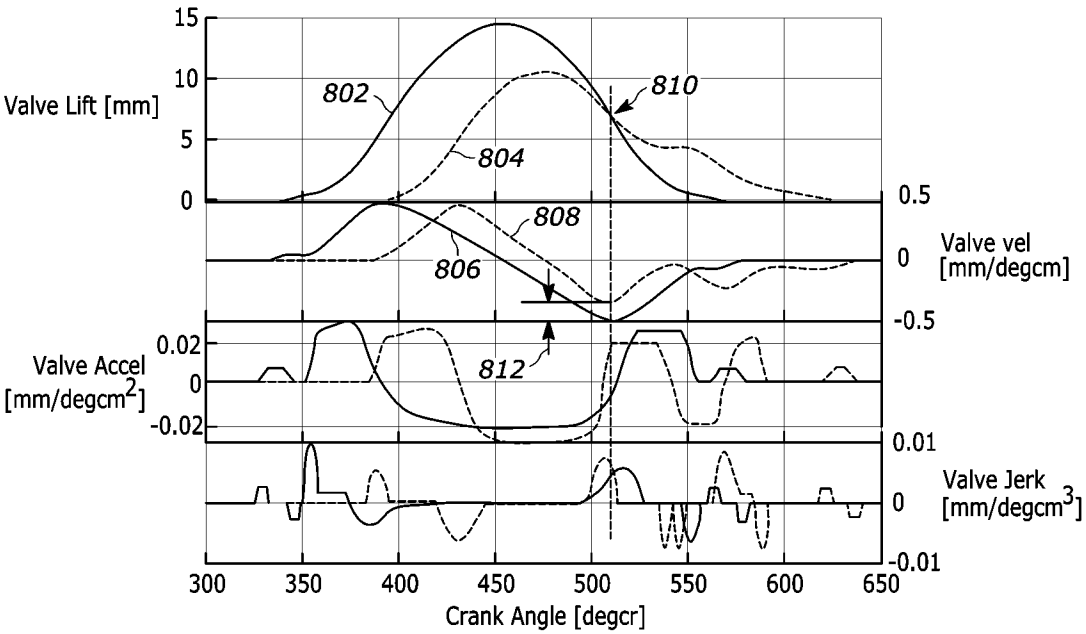
FIG. 8 illustrates a first example of valve lifts and derivatives thereof provided by a first/main valve actuation motion source and by a second/auxiliary valve actuation motion source cooperating to provide late intake valve closing in accordance with the instant disclosure.

To address this potential variability in transition points, it is desirable to design the respective first/main valve lifts and second/auxiliary valve lifts such that a difference in their respective velocities/slopes within the region of the ideal handoff is not greater than a selected maximum threshold. A first example of this, once again in the context of a late intake valve closing event, is illustrated in FIG. 8. In particular, a main intake valve lift 802 is illustrated along with a late intake valve closing lift 804 and an ideal handoff 810. Below the valve lift graph, a further graph illustrating the first derivatives 806, 808 (i.e., velocities) of the respective lifts 802, 804 is shown. Note that additional, angle-aligned graphs illustrating higher order derivatives of the lift curves (acceleration and jerk) are also illustrated. As illustrated by the vertical dashed line at the handoff 810 (at approximately 510° crank angle in the illustrated example), the difference 812 in velocities at the transition point 810 is less than a desired threshold, thereby assuring that excessive impacts at the transition point 810 will not result.

Figure 9:
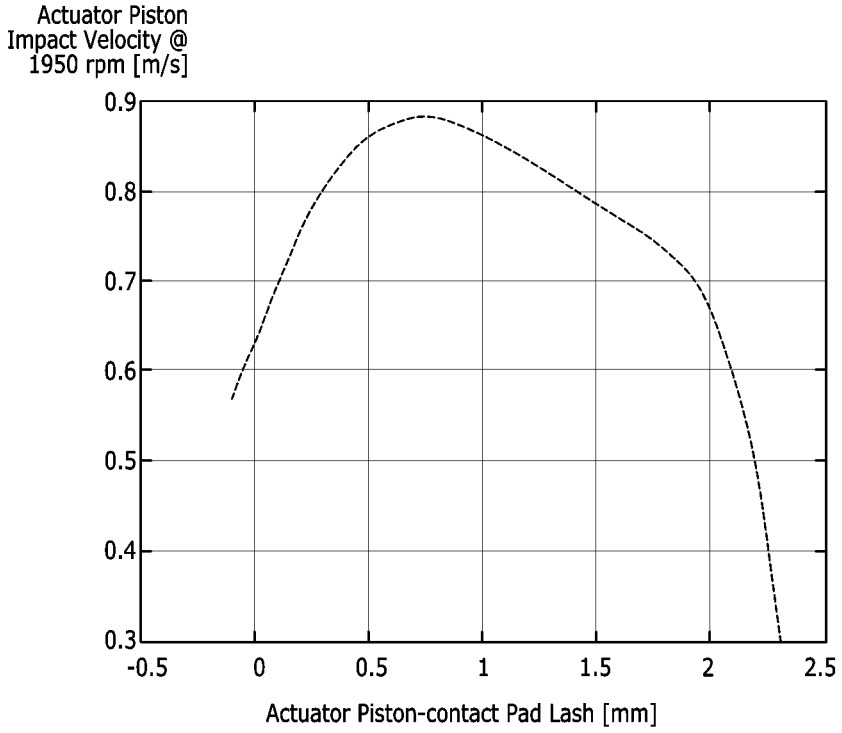
FIG. 9 illustrates impact velocities, as a function of actuator piston extension, between valve train components actuated by cooperative first/main valve actuation motion source and second/auxiliary valve actuation motion source in accordance with the instant disclosure.

In order to accommodate potential delays in actuator extension and/or valve train compliance as described above relative to FIG. 7, it is noted that the velocity 808 of the late intake valve closing lift 804 is maintained at a substantially constant differential relative to the velocity 806 of the main event lift 802 over a large range of crank angle, e.g., from about 490° to about 550°. In this manner, excessive impact velocities over a relatively wide region of actuator deployment positions may be avoided. In particular, this is achieved by choosing the transition point 810 close to the peak closing velocities of both the main and late intake valve closing lift curves 802, 804 because closing velocity varies relatively little with crank angle near peak closing velocity. This minimization of impact velocities despite variable actuator extension is illustrated in FIG. 9, which illustrates calculated values of impact velocities of an actuator piston and contact pad as a function of lash between the actuator piston and contact pad resulting from partial extension of the actuator piston. As shown, the abscissa in FIG. 9 illustrates the amount of lash remaining between the actuator piston and contact pad at the time of valve actuation motion handoff, whereas the ordinate in FIG. 9 illustrates the resulting impact velocity occurring at the time of handoff. In this example, under steady-state conditions in LIVC mode, the actuator piston—contact pad lash is ±0.1 mm, and the kinematic impact velocity is 0.57-0.70 m/s, i.e., the first/main and second/auxiliary rocker arms are designed to accommodate this range of kinematic impact velocities during normal LIVC mode operation. Further this example, the second/auxiliary rocker arm does not interact with the first/main rocker arm for actuator piston—contact pad lash greater than 2.4 mm. In this case, then, the design of the main event lift 802 and the late intake valve closing lift 804 results in a worst-case kinematic impact velocity resulting from partial actuator extension of no more than 0.88 m/s, which, in this particular example, is deemed acceptable. It is noted that the particular threshold value used to designate acceptable maximum differences in valve actuation motion velocities will typically depend on a variety of system-specific factors, and selection thereof is necessarily a matter of design choice. Thus, for example, the particular parameters of the system giving rise to the calculations used to provide FIG. 9 may be able to accept a threshold in which the worst-case kinematic impact velocity is less than 1.5 times the maximum impact velocity during steady-state LIVC operation, i.e., 1.5*0.70 m/s≈1.0 m/s. In this case, then, the worst-case kinematic impact velocity of 0.88 m/s is well below the selected threshold.

Additionally, experience has shown that the number of occurrences of high impact velocity will be limited to transient turn on/off conditions occurring in a small percentage of actuations, e.g., ~2%, as compared to the steady state velocity delta at the handoff. Thus, it is desirable to optimize the velocity delta at the 0 lash position. However, it is understood that a valve actuation system could be designed such the velocity delta at 0 lash may be increased so that the worst-case kinematic impact velocity resulting at larger lash values may be reduced.

Figure 10:
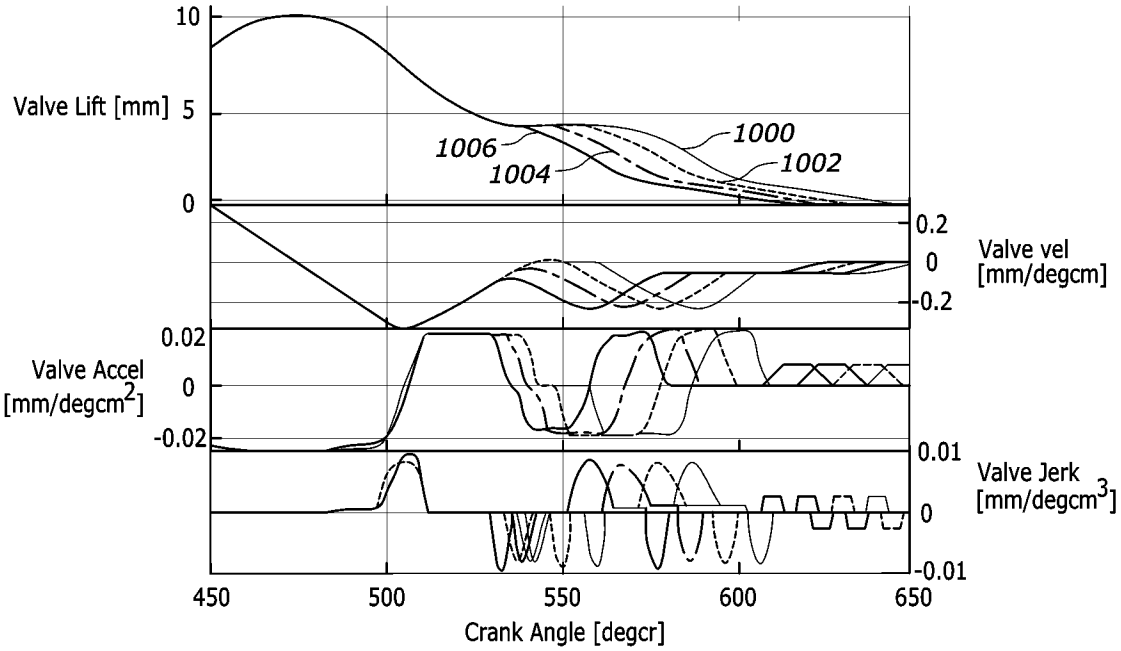
FIG. 10 illustrates a second example of valve lifts and derivatives thereof provided by a first/main valve actuation motion source and by a second/auxiliary valve actuation motion source cooperating to provide late intake valve closing in accordance with the instant disclosure.

FIG. 10 illustrates a series of graphs substantially similar to FIG. 8 showing the closing portion of a family of second/auxiliary cam profiles that provide a range of LIVC closing crank angles 30° to 60° crank angle later than the main intake lift and that illustrate a second/auxiliary cam design method for late or early valve closing. In FIG. 10 second/auxiliary cam profiles for later LIVC closing angles, specifically the 50° (1002) and 60° (1000) profiles, are implemented by varying the length of the "back porch" dwell to achieve the target closing angle. Second/auxiliary cam profiles for earlier LIVC closing angles, specifically the 30° (1006) and 40° (1004) profiles, implemented by reducing the "back porch" dwell to a single point and replacing the dwell at that point with a small closing velocity, i.e., at this single point there is a non-zero velocity and zero acceleration and jerk, and varying this velocity to achieve the target closing angle. This method provides substantially the same handoff relative velocity because these second/auxiliary cam profiles are substantially identical prior to 530° crank angle, and the handoff with the first/main cam profile occurs at 510° crank angle. The method also provides substantially the same acceleration at the start of the back porch dwell, deceleration at the end of the back porch dwell, and valve seating ramp, as illustrated in FIG. 10. In this manner, such profiles would be expected to have nearly the same loading and auxiliary rocker bias spring requirements.

Figure 11:
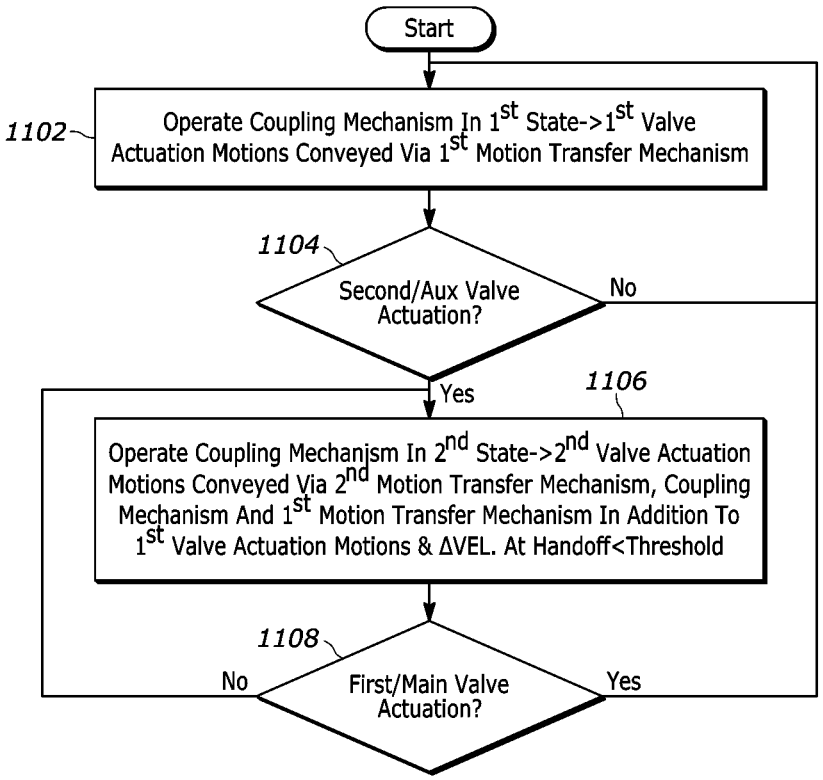
FIG. 11 illustrates a flowchart of operation of a valve actuation system in accordance with the instant disclosure.

FIG. 11 illustrates a flowchart of operation of a valve actuation system in accordance with the instant disclosure. In a presently preferred embodiment, the processing illustrate in FIG. 11 is performed by the control system 116 of FIG. 1 or equivalents thereof dependent upon the system design. Thus, referring to block 1102, the valve actuation system is operated in a mode (e.g., normal, positive power production) such that the coupling mechanism is operated in a first state in which first valve actuation motions provided by the first valve actuation motion source are conveyed to the at least one engine valve via the first motion transfer mechanism. For example, in the case where the coupling mechanism is embodied by an extendable actuator, the first state corresponds to the actuator piston being retracted such that no motions applied to the second motion transfer mechanism are conveyed to the first motion transfer mechanism. While operating in this state, a determination is made at block 1104 whether it has become necessary to operate the valve actuation system such that second/auxiliary valve actuation motions are required. Such a determination could be made on the basis of an affirmative request, e.g., where a user provides input to the control system 116 (via accelerator position, suitable switches, buttons or the like) requesting such operation, or on the basis of identifying engine operating conditions (via suitable sensor inputs to the control system such as oil temperature, engine speed, vehicle speed, etc.) where such operation would be beneficial. If it is determined that second/auxiliary valve actuation motions are not required at block 1104, processing continues at block 1102.

On the other hand, if it is determined that second/auxiliary valve actuation motions are required at block 1104, processing continues at block 1106 where the valve actuation system is operated in a mode (e.g., EEVO, LIVC, etc.) such that the coupling mechanism is operated in a second state in which, in addition to the first valve actuation motions conveyed via the first motion transfer mechanism, second valve actuation motions provided by the second valve actuation motion source are conveyed to the at least one engine valve via the second motion transfer mechanism, the coupling mechanism and the first motion transfer mechanism, and where such first and second actuation motions are configured such that a difference in their respective velocities at a point of handoff is less than a threshold. For example, once again in the case the coupling mechanism is embodied by the extendable actuator, the second state corresponds to the actuator piston being extended such that motions applied to the second motion transfer mechanism are conveyed to the first motion transfer mechanism. While operating in this state, a determination is made at block 1108 whether it has become necessary to operate the valve actuation system such that only first/main valve actuation motions are required. Once again, such a determination could be made on the basis of an affirmative request or on the basis of identifying suitable engine operating conditions as described above. If it is determined that first/main valve actuation motions are not required at block 1108, processing continues at block 1106. Otherwise, if it is determined that first/main valve actuation motions are required at block 1108, processing once again continues at block 1102.

While particular preferred embodiments have been shown and described, those skilled in the art will appreciate that changes and modifications may be made without departing from the instant teachings. For example, the embodiments and implementations of second/auxiliary valve actuation motions described herein have been on the basis of specific valve actuation in which a handoff is achieved between first/main valve actuation motions and second/auxiliary valve actuation motions. However, these second/auxiliary valve actuation motions need not be limited in this regard and may include other valve actuation motions that do not lead to points of non-zero lift handoffs. For example, with reference to FIG. 6, the second/auxiliary valve lift could include, in addition to the late intake valve closing event 652 that leads to the handoff with the main event 650, one of the other second/auxiliary valve lift 310 that would not lead to any handoff with main event (beyond those periods in which both the main event 650 and second/auxiliary valve lift 310 are at zero lift values). It is therefore contemplated that any and all modifications, variations or equivalents of the above-described teachings fall within the scope of the basic underlying principles disclosed above and claimed herein.

What is claimed is:

1. A valve actuation system for actuating at least one engine valve, the valve actuation system comprising:

a first motion transfer mechanism operatively connected to a first valve actuation motion source and to the at least one engine valve;

a second motion transfer mechanism operatively connected to a second valve actuation motion source; and a selectable coupling mechanism disposed between the first motion transfer mechanism and the second motion transfer mechanism, wherein, when the selectable coupling mechanism is operated in a first state, first valve actuation motions provided by the first valve actuation motion source are conveyed to the at least one engine valve via the first motion transfer mechanism and, when the selectable coupling mechanism is operated in a second state, in addition to the first valve actuation motions conveyed via the first motion transfer mechanism, second valve actuation motions provided by the second valve actuation motion source are conveyed to the at least one engine valve via the second motion transfer mechanism, the coupling mechanism and the first motion transfer mechanism, and wherein, during a handoff between the first valve actuation motions and the second valve actuation motions or vice versa, a difference in valve actuation velocities of the first valve actuation motions and the second valve actuation motions does not exceed a threshold.

2. The valve actuation system of claim 1, the selectable coupling mechanism comprising a selectively extendable actuator, wherein the actuator is retracted during the first state and is extended during the second state.

3. The valve actuation system of claim 2, wherein the difference in valve actuation velocities does not exceed the threshold during transition of the actuator from the first state to the second state.

4. The valve actuation system of claim 1, wherein the first valve actuation motions comprise a main event profile.

5. The valve actuation system of claim 1, wherein the handoff occurs during an opening segment of the first valve actuation motions.

6. The valve actuation system of claim 5, wherein the second valve actuation motions comprise an early valve opening profile.

7. The valve actuation system of claim 6, wherein the second valve actuation motions further comprise a valve actuation motion that does not give rise to a handoff with the first valve actuation motions.

8. The valve actuation system of claim 1, wherein the handoff occurs during a closing segment of the first valve actuation motions.

9. The valve actuation system of claim 8, wherein the second valve actuation motions comprise a late valve closing profile.

10. The valve actuation system of claim 9, wherein the second valve actuation motions further comprise a valve actuation motion that does not give rise to a handoff with the first valve actuation motions.

11. The valve actuation system of claim 1, wherein the at least one engine valve comprises an intake valve.

12. The valve actuation system of claim 1, wherein the at least one engine valve comprises an exhaust valve.

13. The valve actuation system of claim 1, wherein the first and second valve actuation motion sources are cam profiles.

14. The valve actuation system of claim 13, wherein the opening or closing portion of the second valve actuation cam profile comprises a dwell or a single point with non-zero velocity and zero acceleration and jerk.

15. An internal combustion engine comprising the valve actuation system of claim 1.

16. In an internal combustion engine comprising a first motion transfer mechanism operatively connected to a first valve actuation motion source and to at least one engine valve, a second motion transfer mechanism operatively connected to a second valve actuation motion source and a selectable coupling mechanism disposed between the first motion transfer mechanism and the second motion transfer mechanism, a method for actuating the at least one engine valve comprising:

operating the selectable coupling mechanism in a first state where first valve actuation motions provided by the first valve actuation motion source are conveyed to the at least one engine valve via the first motion transfer mechanism; and operating the selectable coupling mechanism in a second state where, in addition to the first valve actuation motions conveyed via the first motion transfer mechanism, second valve actuation motions provided by the second valve actuation motion source are conveyed to the at least one engine valve via the second motion transfer mechanism, the coupling mechanism and the first motion transfer mechanism, wherein, during a handoff between the first valve actuation motions and the second valve actuation motions or vice versa, a difference in valve actuation velocities of the first valve actuation motions and the second valve actuation motions does not exceed a threshold.

* * * * *